US008317358B2

(12) United States Patent
Chou

(10) Patent No.: US 8,317,358 B2
(45) Date of Patent: Nov. 27, 2012

(54) METHOD AND APPARATUS FOR PROVIDING AN OMNI-DIRECTIONAL LAMP HAVING A LIGHT EMITTING DIODE LIGHT ENGINE

(75) Inventor: Der Jeou Chou, Mesa, AZ (US)

(73) Assignee: Enertron, Inc., Tempe, AZ (US)

( * ) Notice: Subject to any disclaimer, the term of this patent is extended or adjusted under 35 U.S.C. 154(b) by 658 days.

(21) Appl. No.: 12/236,993

(22) Filed: Sep. 24, 2008

(65) Prior Publication Data

US 2009/0080187 A1 Mar. 26, 2009

Related U.S. Application Data

(60) Provisional application No. 60/975,109, filed on Sep. 25, 2007.

(51) Int. Cl.
*F21V 7/20* (2006.01)
*F21V 29/00* (2006.01)

(52) U.S. Cl. ..... 362/218; 362/373; 362/249.02

(58) Field of Classification Search ..... 362/218, 362/194, 345, 373, 249.01, 249.02, 249.05, 362/249.06

See application file for complete search history.

(56) References Cited

U.S. PATENT DOCUMENTS

| | | | | |
|---|---|---|---|---|
| 2003/0189829 | A1 * | 10/2003 | Shimizu et al. | 362/240 |
| 2004/0165387 | A1 * | 8/2004 | Zhang | 362/294 |
| 2005/0073244 | A1 * | 4/2005 | Chou et al. | 313/498 |
| 2006/0092639 | A1 * | 5/2006 | Livesay et al. | 362/294 |
| 2006/0250801 | A1 * | 11/2006 | Trenchard et al. | 362/294 |
| 2008/0170392 | A1 * | 7/2008 | Speier et al. | 362/227 |
| 2008/0253125 | A1 * | 10/2008 | Kang et al. | 362/294 |

* cited by examiner

*Primary Examiner* — William Carter

(74) *Attorney, Agent, or Firm* — Robert D. Atkins; Patent Law Group: Atkins & Associates, P.C.

(57) ABSTRACT

An LED lamp includes a light engine. The light engine includes a substrate including a transparent or translucent thermally conductive material, a plurality of LED semiconductor devices mounted to the substrate, a plurality of conductive traces formed over the substrate to electrically interconnect each of the plurality of LED semiconductor devices, and conductive leads connected to the substrate for supplying electrical energy to the plurality of LED semiconductor devices. The substrate of the light engine may include an aluminum nitride (AlN), or diamond film material. A thermally conductive rod is connected to the light engine. A heatsink is formed by an extrusion or die casting process. The heatsink includes a fin structure for dissipating heat energy into the environment. The thermally conductive rod and the heatsink are thermally connected. An optional optical envelope is mounted to the heatsink. The optional optical envelope is disposed over the light engine.

27 Claims, 4 Drawing Sheets

METHOD AND APPARATUS FOR PROVIDING AN OMNI-DIRECTIONAL LAMP HAVING A LIGHT EMITTING DIODE LIGHT ENGINE

CLAIM TO DOMESTIC PRIORITY

The present non-provisional patent application claims priority to provisional application Ser. No. 60/975,109, entitled "Omni Directional Light Emitting LED Light," and filed on Sep. 25, 2007.

FIELD OF THE INVENTION

The present invention relates in general to lighting products and, more particularly, to a light-emitting diode (LED) lamp configured to provide an omni-directional light source.

BACKGROUND OF THE INVENTION

Light emitting diodes (LEDs) have been used for decades in applications requiring relatively low-energy indicator lamps, numerical readouts, and the like. In recent years, however, the brightness and power of individual LEDs have increased substantially, resulting in the availability of 1 watt and 5 watt devices.

while small, LEDs exhibit a high efficacy and life expectancy as compared to traditional lighting products. A typical incandescent bulb has an efficacy of 10 to 12 lumens per watt, and lasts for about 1,000 to 2,000 hours; a general fluorescent bulb has an efficacy of 40 to 80 lumens per watt, and lasts for 10,000 to 20,000 hours; a typical halogen bulb has an efficacy of 20 lumens and lasts for 2,000 to 3,000 hours. In contrast, white LEDs can emit 100 lumens per watt with a life-expectancy of about 100,000 hours.

The light engine of an LED lamp typically includes a high thermal conductivity substrate, an array of individual LED semiconductor devices mounted on the substrate, and a transparent polymeric encapsulant, e.g., optical-grade silicone, deposited on the LED devices.

The LED must maintain its junction temperature in the proper rated range to maximize its efficacy, longevity, and reliability. Accordingly, the construction of the light engine must provide for dissipation of the heat generated by the LEDs. High-power LED lights are housed within finned fixtures, for example. The fins dissipate the heat to ambient surroundings.

In general, LED lamps provide a high-efficiency light source, but due to their construction do not provide the same light output characteristics as conventional light sources. For example, unlike typical omni-directional incandescent or fluorescent lamps, the illumination pattern of LEDs tends to be directional, like that of a floodlight, down light, spot light or task light. Accordingly, light engines formed with LEDs tend to generate high-intensity and one-half spherical beams of light. As such, LED lamps are not light sources for illuminating a room, office, or other space as an incandescent lamp does by emitting light fully spherically. Because LEDs themselves are directional lighting devices, it is difficult to manufacture an omni-directional LED lamp.

SUMMARY OF THE INVENTION

In one embodiment, the present invention is a method of manufacturing a light emitting diode (LED) lamp comprising providing a light engine. The light engine includes a substrate including a transparent or translucent thermally conductive material, a plurality of LED semiconductor devices mounted to the substrate, a plurality of conductive traces formed over the substrate to electrically interconnect each of the plurality of LED semiconductor devices, and conductive leads connected to the substrate for supplying electrical energy to the plurality of LED semiconductor devices. The method includes connecting a thermally conductive rod to the light engine, and forming a heatsink by an extrusion, molding, stamping or die casting process. The heatsink includes a fin structure for dissipating heat energy into the environment. The method includes thermally connecting the thermally conductive rod and the heatsink.

In another embodiment, the present invention is a method of manufacturing a light emitting diode (LED) lamp comprising providing a light engine including a substrate and a plurality of LEDs mounted to the substrate, connecting a thermally conductive structure to the light engine, and providing a heatsink having a fin structure for dissipating heat energy into the environment. The method includes thermally connecting the thermally conductive structure and the heatsink.

In another embodiment, the present invention is a method of manufacturing a lamp comprising providing a light source, connecting a thermally conductive structure to the light source, and providing a heatsink for dissipating heat energy into the environment. The method includes thermally connecting the thermally conductive structure and the heatsink.

In another embodiment, the present invention is a light emitting diode (LED) lamp comprising a light engine including a substrate and a plurality of LEDs mounted to the substrate, a thermally conductive structure connected to the light engine, and a heatsink having a fin structure for dissipating heat energy into the environment. The thermally conductive structure is thermally connected to the heatsink.

DETAILED DESCRIPTION OF THE DRAWINGS

The present invention is described in one or more embodiments in the following description with reference to the Figures, in which like numerals represent the same or similar elements. While the invention is described in terms of the best mode for achieving the invention's objectives, it will be appreciated by those skilled in the art that it is intended to cover alternatives, modifications, and equivalents as may be included within the spirit and scope of the invention as defined by the appended claims and their equivalents as supported by the following disclosure and drawings.

LED light sources provide a brilliant light in many settings. LED lamps are efficient, long-lasting, cost-effective, and environmentally friendly. LED lighting is rapidly becoming the light source of choice in many applications.

One important design aspect of LED lighting is the need for efficient heat dissipation. Excessive heat minimizes the lifespan of LED light sources. In some cases, excessive heat also modifies the operating characteristics of an LED light source. For example, because the light generation properties of many LED light sources are at least partially governed by temperature, a significant change in the ambient temperature surrounding an LED light source may cause a change in the color temperature (CCT) of white light emitted from the device. Accordingly, a thermally efficient LED lamp minimizes the CCT shift and prolongs the lifespan of the light source contained within the lamp.

Also, because LEDs generally emit light in a single direction, the light engines manufactured using LEDs to output beams of light in a configuration equal or less than one-half spheric. As a result, in LED lamp applications where the light engine is mounted directly to a surface of a heatsink, for example, the light emitted from the LED lamp is directional as in conventional floodlight, down light, spot light, or task light applications.

Accordingly, when preparing an omni-directional LED lamp, it is necessary for the LEDs or the light engine to be suspended in a central location of the LED lamp away from the heatsink, which minimizes the amount of light blocked by the internal structure of the light source. Because the light engine is placed in a central region of the lamp away from the heatsink, it is also important that there be an effective heat transfer path formed between the light engine and one or more heatsinks connected to the lamp to efficiently remove heat energy from the light engine and dissipate it from the lamp. Otherwise, as the LED lamp operates, heat energy generated by the light engine is captured within the LED lamp causing inefficient operation and possible damage to the device.

Figure 1A:
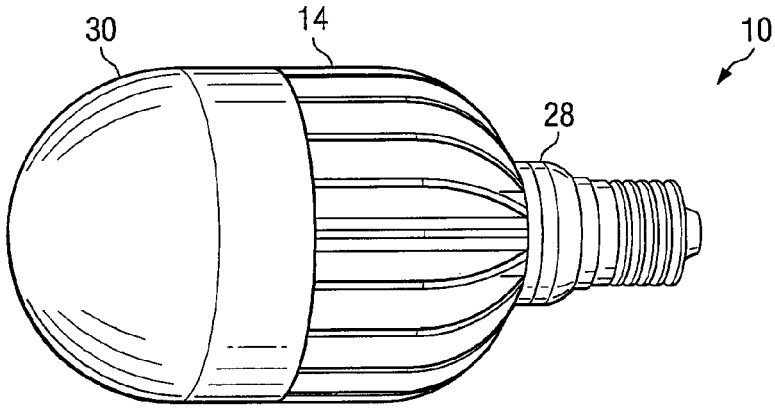
FIG. 1*a* illustrates a perspective view of a light-emitting diode (LED) lamp having an integrated heatsink and light engine, an optional optical envelope or housing is mounted to the LED lamp.
Figure 1B:
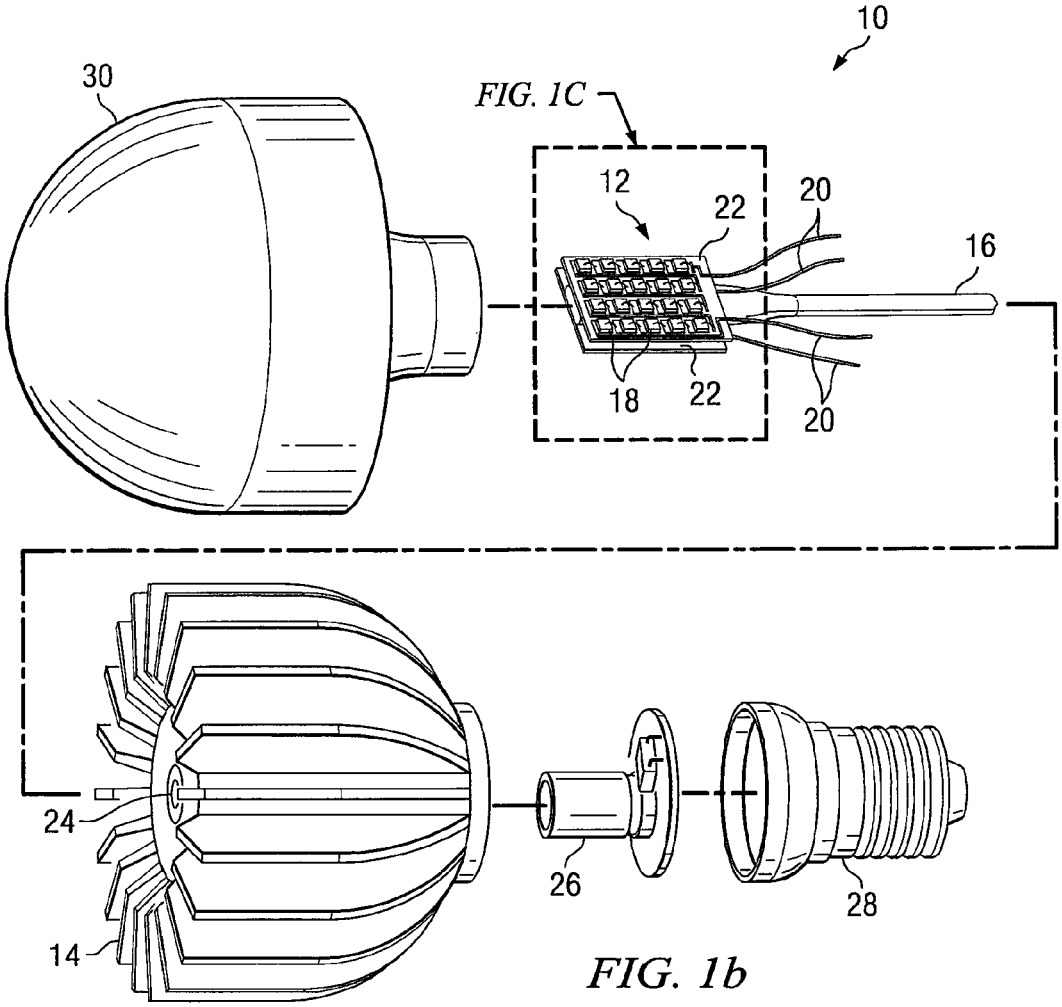
FIG. 1*b* illustrates an exploded view of an LED lamp showing how the components of the LED lamp fit together.
Figure 1C:
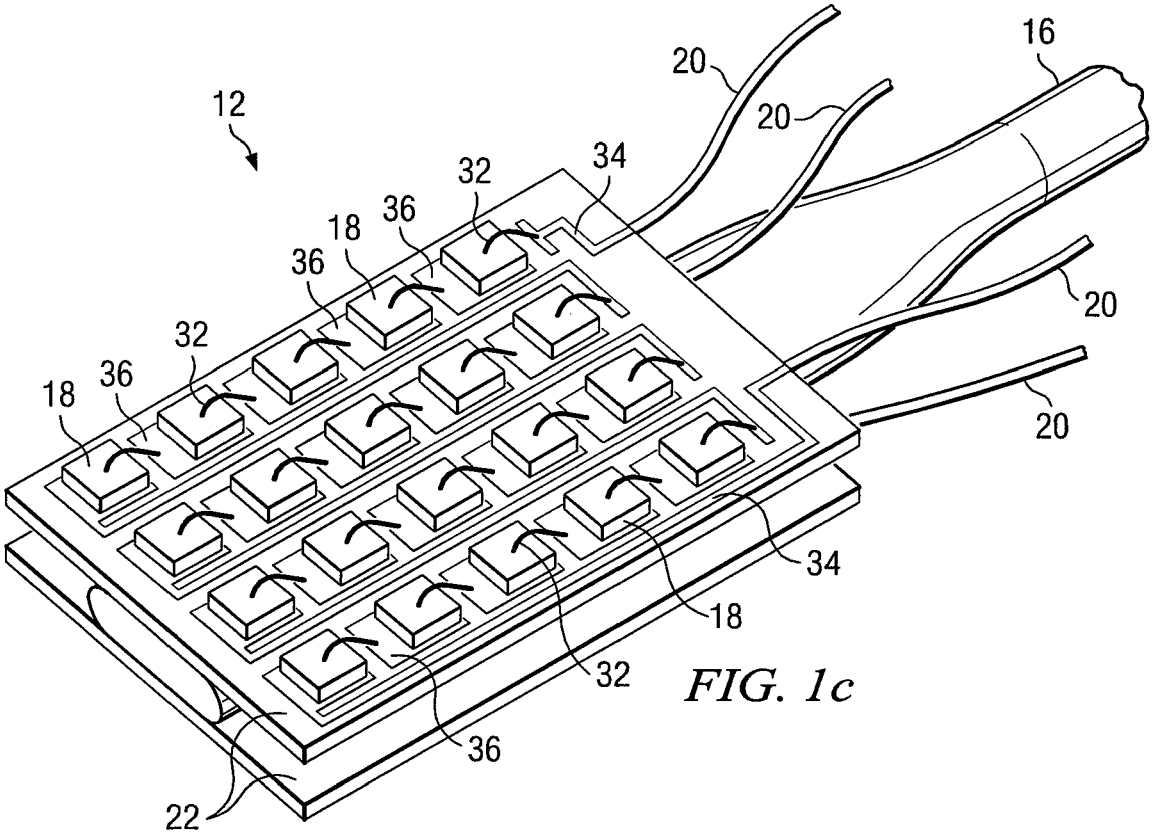
FIG. 1*c* illustrates a detailed view of the light engine of an LED lamp, the light engine includes a plurality of LEDs mounted to a substrate.

FIGS. 1*a* and 1*b* illustrate omni-directional LED lamp 10. FIG. 1*a* shows a perspective view of LED lamp 10 and FIG. 1*b* shows an exploded view of LED lamp 10 illustrating how some of the components of LED lamp 10 fit together. FIG. 1*c* illustrates a detailed view of light engine 12 of LED lamp 10.

Referring to FIGS. 1*a* and 1*b*, LED lamp 10 is configured to provide an omni-directional light source with efficient heat dissipation. LED lamp 10 includes several components which provide for wide dispersion of light generated by light engine 12. The components are also configured to provide efficient removal of heat energy from light engine 12 and dissipation of heat energy from LED lamp 10. LED lamp 10 may also include one or more coatings formed over an optical envelope or housing that provides mechanical protection to the components of LED lamp 10 and also provides diffusion of light generated by light engine 12.

LED lamp 10 includes light engine 12 for generating light to be radiated from LED lamp 10. In alternative embodiments, however, other light sources such as conventional light bulbs may replace light engine 12. Light engine 12 includes a plurality of LED semiconductor devices 18 that are mounted to contact pads 36 of substrates 22. Depending upon the application, LEDs 18 may be mounted over front and back surfaces of substrates 22.

Within light engine 12, LEDs 18 are electrically interconnected using wirebonds, solder bonds, or other electrical connections formed over each substrate. Rod 16 is connected or mounted to substrates 22 of light engine 12 and includes a thermally conductive material for collecting and removing heat energy generated by light engine 12 via substrates 22. With reference to FIG. 1*b*, rod 16 is disposed between substrates 22. In one embodiment, substrates 22 and rod 16 are formed as a single contiguous component of LED lamp 10. Depending upon the application, however, rod 16 may be replaced by another thermally conductive structure having an alternative geometrical shape. For example, rod 16 may be solid metal, or a heat pipe. Rod 16 can be replaced by a thermally conductive sheet, spike, pyramid, or other solid shape. Rod 16 includes aluminum, copper, carbon composite or another thermally conductive material. Leads 20 are electrically connected to LEDs 18 of light engine 12 to supply energy to LEDs 18. As shown in FIG. 1*a*, leads 20 lay outside rod 16. In alternative embodiments, however, rod 16 is hollow and leads 20 pass through an interior portion of hollow rod 16. In some cases, rod 16 includes an electrically conductive material and forms a portion of the electrical circuit supplying energy to light engine 12. Rod 16 may comprise a plurality of pipes that include hollow copper or aluminum vessels with an internal wicking structure and working fluid such as water or other fluid or gas to facilitate heat transfer—a device commonly referred to as a heat pipe. Alternatively, rod 16 can be made of a solid metal structure including copper, aluminum or other thermally conductive material. In further alternative embodiments, rod 16 includes any thermally conductive structure mounted to or connected to substrates 22.

Depending upon the application, rod 16 may be mounted to any portion of light engine 12 and in any orientation with respect to one or more substrates 22. As shown in FIG. 1*b*, rod 16 is mounted to substrates 22 such that the length of rod 16 lies parallel to the planes formed by substrates 22. In alternative embodiments, however, rod 16 may be mounted perpendicular to a surface of substrates 22, mounted to one corner of a substrate 22, or multiple rods 16 having different orientations may be coupled to different regions of substrates 22, for example. Furthermore, rod 16 may be curved, bent or otherwise angled to modify the orientation and/or placement of light engine 12 within LED lamp 10.

Light engine 12 is mounted to heatsink 14 by inserting rod 16 into recess or opening 24 formed in heatsink 14. Opening 24 is configured so that the outer surface of rod 16 contacts an inner surface of opening 24. The mechanical connection between rod 16 and heatsink 14 facilitates the transfer of heat energy from rod 16 into heatsink 14. Depending upon the application, a thermally conductive material such as thermal grease, thermally conductive adhesive, solder, or a thermal interface pad is disposed between the outer surface of rod 16 and the surface of opening 24 to further enhance the transfer of thermal energy between rod 16 and heatsink 14. In alternative embodiments, the thermal connection between light engine 12 and heatsink 14 is formed using copper, aluminum, graphite, or carbon composite materials, or a heat pipe structure.

Heatsink 14 includes a thermally conductive material including copper, aluminum, graphite, and carbon composite materials and is formed using an extrusion, die casting, stamping, or molding process. Heatsink 14 includes a plurality of flat leaf fin structures to facilitate dissipation of heat energy collected by heatsink 14 into the surrounding air by convection or another heat-transfer process. Depending upon the application, heatsink 14 includes any combination of leaf fins, pin fins, disc fins, or other structures to increase the surface area of heatsink 14 to improve dissipation of heat energy from heatsink 14 into the environment. Heatsink 14 provides structural support to LED lamp 10 and provides a mounting point for the components of LED lamp 10. Also, heatsink 14 is configured to maintain a particular LED junction temperature within light engine 12 during operation of LED lamp 10. In one embodiment, the materials used to fabricate heatsink 14, in addition to its shape, size and fin configuration, are tailored to control the LED junction temperature of light engine 12. Heatsink 14 is thermally and mechanically connected to rod 16 to provide for transfer of heat energy from rod 16 to heatsink 14. In one embodiment, heatsink 14 is connected to rod 16 by friction coupling, for example by coating rod 16 with thermal grease and inserting rod 16 into opening 24 formed in heatsink 14 and forming a tight fit between rod 16 and heatsink 14. However in other embodiments thermally conductive adhesives, solder, or mechanical fasteners such as bolts or screws may be used to connect rod 16 and heatsink 14. In one embodiment, the outer surface of rod 16 is coated with a thermally conductive adhesive material and rod 16 is inserted into opening 24 of heatsink 14. In another embodiment, an outer surface of rod 16 is machined or fabricated to include a helical thread configured to mate with a helical groove formed within a surface of opening 24. In this configuration, rod 16 is screwed into opening 24 to form the mechanical thermal connection between rod 16 and heatsink 14.

Heatsink 14 includes additional holes or passageways to allow leads 20 of light engine 12 to pass through heatsink 14 for connection to a power supply. In some embodiments, however, both leads 20 and rod 16 pass through the same opening formed within heatsink 14.

Power supply 26 is connected to a backside of heatsink 14. Power supply 26 includes connectors for coupling to leads 20 of light engine 12. Power supply 26 receives energy from an electricity source (not shown) such as a wall socket, or other electrical connection, and supplies energy to light engine 12 via leads 20. Depending upon the application, power supply 26 modifies the energy received from the electricity source before delivering it to light engine 12. For example, if the power source is an alternating-current (AC) power source and light engine 12 is operated using a direct-current (DC) power source, power supply 26 includes an AC-to-DC converter circuit connected between the power source and light engine 12. In one embodiment, the conversion circuit includes a circuit board that is mounted within heatsink 14. Similarly, power supply 26 includes any voltage step-up or step-down circuitry necessary for supplying a correct forward DC voltage to light engine 12. For example, power supply 26 may include a switching step-down circuit for modifying a 120 volt AC supply into a 24 volt DC supply.

In one embodiment, power supply 26 is connected to heatsink 14 using a plurality of fasteners. In embodiments wherein heatsink 14 acts as a heatsink for power supply 26, a thermally conductive material such as thermal grease is deposited between power supply 26 and heatsink 14. For example, in one embodiment, a thermally conductive adhesive material connects power supply 26 and heatsink 14.

Socket 28 is connected to power supply 26 of LED lamp 10. Socket 28 is configured to connect to a conventional light-bulb socket for connecting LED lamp 10 to an electricity source. Socket 28 may include an E26/E27 bulb socket, a GU24 socket, or any other types of connectors. Depending upon the application, the electricity source may be a standard 120 VAC, 220 VAC, 277 VAC, or other AC source or a DC power source. In alternative embodiments, however, socket 28 includes any socket for connecting to a power supply for supplying electricity to power supply 26 of LED lamp 10.

An optional optical envelope or housing 30 is mounted to heatsink 14 using a friction coupling, fastener, or other attachment mechanism. Optical envelope 30 may be clear or coated with one or more light-diffusing materials. In one embodiment, the coating diffuses the intensive spotlight formed by LEDs 18 into a relatively smooth light source. Depending upon the application, optical envelope 30 has a ball, dome-shape, or other geometrical configuration. Optical envelope 30 may be transparent, translucent, or frosty and may include polarizing filters, colored filters or additional lenses such as concave, convex, planar, "bubble", and Fresnel lenses. If the light source generates light having a plurality of distinct colors, optical envelope 30 may be configured to diffuse the light to provide sufficient color blending. In a further alternative embodiment, a reflector ring (not shown) is formed over an interior portion of optical envelope 30. The reflector ring surrounds light engine 12 and reflects the light emitted from LEDs 18 away from heatsink 14 towards the transparent or translucent portion of optical envelope 30. In other embodiments, however, a reflector may be mounted directly to heatsink 14 to reflect light generated by light engine 12 away from heatsink 14 towards optical envelope 30.

As light engine 12 operates, each LED 18 of light engine 12 generates thermal energy. The thermal energy is transmitted from each LED 18 into substrates 22 of light engine 12. From substrates 22, the thermal energy is transmitted into rod 16. Because rod 16 includes a thermally conductive material, the thermal energy is transmitted through rod 16 into heatsink 14. As heatsink 14 accumulates heat energy, it is dissipated from heatsink 14 via the plurality of fins formed as part of heatsink 14. Depending upon the application, the heat energy is dissipated into the air surrounding LED lamp 10. However, if LED lamp 10 is sealed so as to operate in a submerged environment, heatsink 14 dissipates the heat energy into the surrounding liquid.

In this configuration, LED lamp 10 provides light engine 12 for generating light that is emitted by LED lamp 10. Because light engine 12 is suspended away from heatsink 14, any light emitted from LED lamp 10 is not blocked by heatsink 14 and instead passes through optical envelope 30, where it is diffused. Even though light engine 12 is suspended within LED lamp 10, an effective thermal path is formed between LEDs 18 and substrate 22 of light engine 12, through rod 16 into heatsink 14, where the heat energy is dissipated from LED lamp 10.

FIG. 1*c* shows an expanded view of light engine 12 illustrating additional detail of LEDs 18 and substrates 22. The performance of light engine 12 relates to the junction temperature of LEDs 18 mounted to light engine 12. As the junction temperature increases, the performance of each LED 18 decreases. Not only does the amount of light output by each LED 18 decrease, but an increase in junction temperature may alter the color output by each LED 18.

Light engine 12 includes substrates 22. As shown in FIG. 1*c*, light engine 12 includes two substrates 22 having thermally conductive rod 16 mounted between each substrate 22. In one embodiment, light engine 12 includes a thermally conductive structure having an oval cross section between substrates 22, but a circular cross section away from substrates 22. In this configuration, the flattened portion of rod 16 maximizes the contact area between rod 16 and substrates 22 to maximize heat transfer between substrates 22 and rod 16. In one embodiment, substrates 22 include a thermally conductive and transparent or translucent material. For example, substrates 22 may include a ceramic material such as aluminum nitride (AlN), aluminum oxide (Al203), or a fiber glass board such as FR4, a metal clad dielectric board, or a diamond film material. An additional fluorescent or phosphorous material may be formed over a surface of substrates 22 or formed within substrates 22 to further emphasize the light output of light engine 12, promote even light spreading, and allow portions of substrates 22 to fluoresce. As LEDs 18 generate light, the fluorescent or phosphorous material absorbs some of the photons generated by LEDs 18 and emits additional photons having a particular range of wavelengths. By adjusting the wavelength of the emitted light, the fluorescent or phosphorous material promotes light output and light spreading.

LEDs 18 are mounted as semiconductor devices over a surface of each substrate 22 using an appropriate surface mount technology. Depending upon the application, LEDs 18 may be mounted over a front and back surface of light engine 12. With reference to FIG. 1*c*, LEDs 18 are mounted to contact pads 36 using a die attach adhesive. To establish the first electrical interconnection and to promote the transfer of thermal energy between LEDs 18 and contact pads 36, an electrically and thermally conductive die attach material may be used to bond LEDs 18 to contact pads 36. A second electrical interconnection is formed between LEDs 18 and a proximate contact pad 36. Contact pads 36 are formed over surfaces of substrates 22. Contact pads 36 are made with an electrically conductive material, such as aluminum, copper, tin, nickel, gold, or silver and may be formed by thick film screen printing, PVD, CVD, electrolytic plating, or an electroless plating process, for example. Wirebonds 32 are formed between LEDs 18 and a proximate contact pad 36 of substrates 22. In alternative embodiments, other surface mount technologies, including flip-chip mounting using solder ball bonds or electrically conductive epoxy bonds, are used to mount and electrically connect LEDs 18 to contact pads 36. Conductive traces 34 are formed on a surface or within layers of substrates 22 using thick film screen printing, PVD, CVD, electrolytic plating, an electroless plating process, or other suitable metal deposition process. Traces 34 provide for electrical communication and interconnect each row of LEDs 18. Traces 34 are connected to the last contact pads 36 in a row to the first contact pads 36 of the next row, and leads 20 for providing power to LEDs 18. In alternative embodiments, the LEDs have top-in and top-out bond pads. In that embodiment, wirebonds 32 are connected from the LED top bond pads formed on the LED to the top bond pads formed on nearby LEDs. For example, the top-in bond pad on one LED may be connected to the top-out bond pad of another LED.

Depending upon the application, light engine 12 may include any number of substrates having LEDs mounted to one or more surfaces of each substrate. For example, in a light engine having 3 substrates, the substrates may be connected to form a triangular shape, with LEDs mounted only to the outer surfaces of each substrate. Similarly, light engine 12 may include a plurality of substrates configured to form a cube, pyramid, or other polyhedron shapes. In those configurations, LEDs are mounted to the outer surface of each substrate to form the light engine.

The number of LEDs 18 incorporated into light engine 12 is selected in accordance with a number of design variables, such as type of power source, forward voltage ($V_f$) or power rating of each LED 18, and desired color combination. For example, LEDs 18 can be connected in series or parallel such that the overall combined $V_f$ of the LED devices matches the electrical input. In one embodiment, 40 to 80 LEDs 18 can be electrically connected in series, depending upon the $V_f$ of the individual LEDs. By matching the combined forward voltage of the LEDs with the voltage of the input source, the power supply for the light engine can be simplified such that no bulky, complicated voltage step-up or step-down transformers, or switching power supply which all have conversion losses, need be used in connection with the system. In some cases, the switching power supply can be used in a constant current configuration.

In one example light engine, a blue or green LED 18 manufactured using an InGaN base compound semiconductor has a forward voltage of about 3 volts. In the light engine, the red and yellow LEDs 18 are formed using an AlGaInP base compound semiconductor and have a forward voltage of about 2 volts. In the light engine, 25 red LEDs, 10 yellow LEDs, 25 green LEDs, and 5 blue LEDs connected in series can be operated at a potential input of 160 volts. The 160 volt input is provided via lead wires 20 and is approximately equal to the voltage resulting from a rectified 120 volt AC input. In another example, larger size LED chips are used (including 40×40 mils, or 80×80 mils) and the number of LEDs on the substrate can be reduced and the overall forward voltage may be lowered. In that case, a switching power supply which can convert 120 VAC to a lower VDC will be used.

In other embodiments, LEDs 18 are manufactured using one or more suitable semiconductor materials, including, for example, GaAsP, GaP, AlGaAs, GaInN, or the like. The individual LED devices have particular colors corresponding to particular wavelengths or frequencies. Multiple LEDs of various colors, e.g., red, green, and blue, can produce the desired color of emitted light.

Within light engine 12, therefore, the combination of LEDs 18 having different colors, such as red, yellow, blue or green LEDs, is controlled to generate a desired color output. By combining LEDs 18 having different output colors, there is no need for a colored lens or filter to alter the output color of LED lamp 10—such a lens or filter would minimize the light output of LED lamp 10 and minimize the device's efficiency.

In general, two white light generating methods may be used. First, using RGB (red green blue) LED mixing, or RAGB (red amber green blue) LED mixing to emit white light. Second, blue LEDs coated with phosphor or ultra-violet (uV) LEDs coated with phosphor, such as a yttrium aluminum garnet (YAG) phosphor, to emit white light.

Figure 2A:
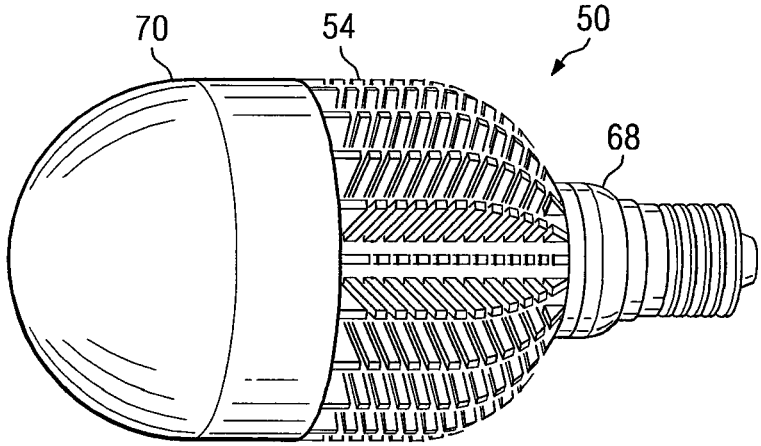
FIG. 2*a* illustrates a perspective view of an LED lamp having a heatsink with a plurality of pin fins for dissipating heat energy.
Figure 2B:
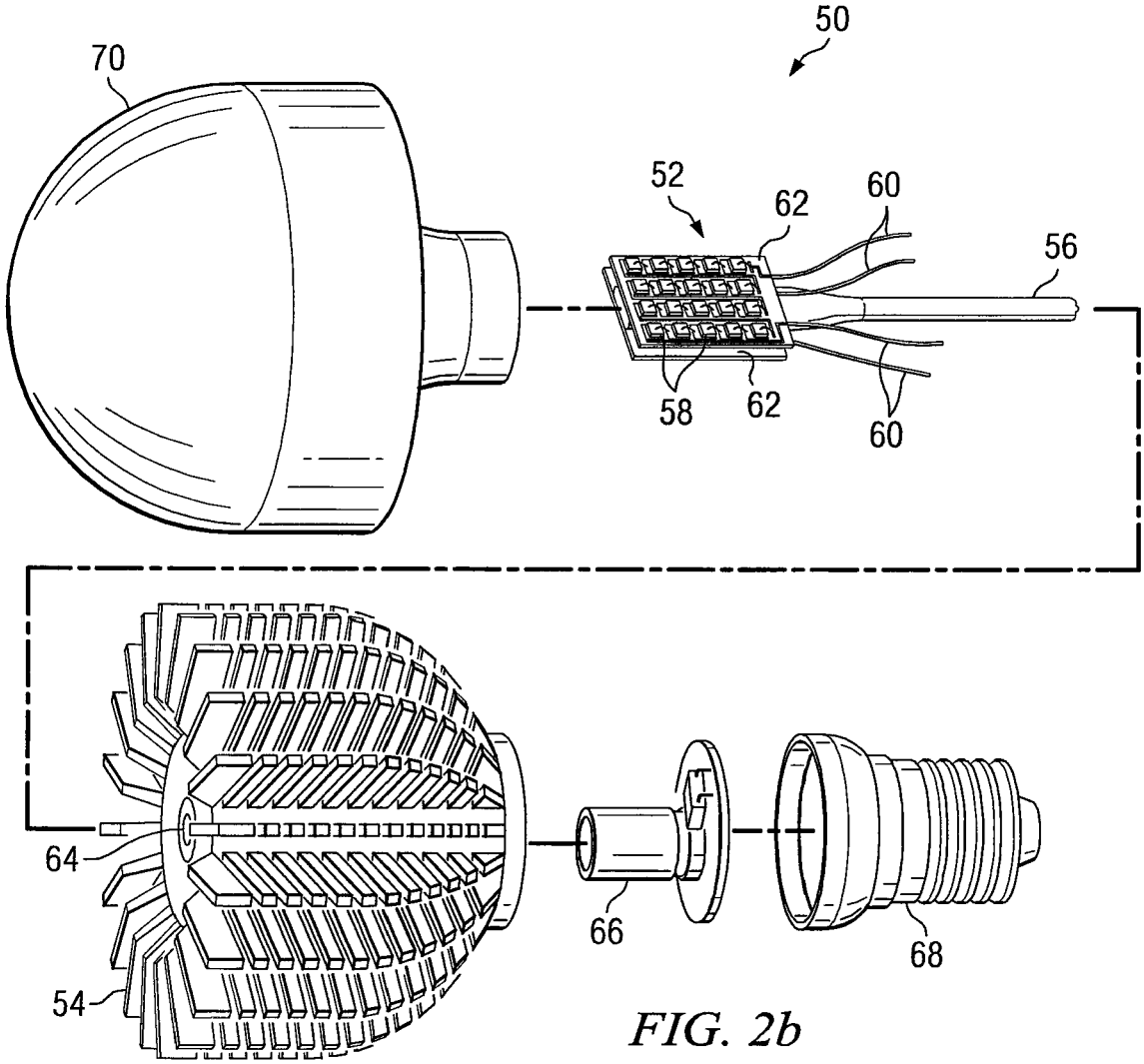
FIG. 2*b* illustrates an exploded view of an LED lamp showing how the components of the LED lamp fit together, the LED lamp includes a heatsink with a plurality of pin fins.

FIGS. 2*a* and 2*b* illustrate omni-directional LED lamp 50. FIG. 2*a* shows a perspective view of LED lamp 50 having a plurality of pin fins for dissipating heat energy. FIG. 2*b* shows an exploded view of LED lamp 50 illustrating how some of the components of LED lamp 50 fit together.

LED lamp 50 includes light engine 52 for generating light to be radiated from LED lamp 50. Light engine 52 includes a plurality of LEDs 58 that are mounted to the contact pads on substrates 62. LEDs 58 are electrically interconnected using wirebonds, traces, or other electrical connections formed over the substrates. Rod 56 is connected or mounted to substrates 62 of light engine 52 and includes a thermally conductive material for collecting and removing heat energy generated by light engine 52. Rod 56 may include aluminum, copper, heat pipe, or another thermally conductive material. Leads 60 are electrically connected to LEDs 58 of light engine 52 to supply energy to LEDs 58.

Light engine 52 is mounted to heatsink 54 by inserting rod 56 into recess or opening 64 formed in heatsink 54. Opening 64 is configured so that the outer surface of rod 56 contacts an inner surface of opening 64. The mechanical connection between rod 56 and heatsink 54 facilitates the transfer of heat energy from rod 56 into heatsink 54. Depending upon the application, a thermally conductive material such as thermal grease, solder, or a thermally conductive pad is disposed between the outer surface of rod 56 and the surface of opening 64 to further enhance the transfer of thermal energy between rod 56 and heatsink 54. The thermal grease may include a ceramic, carbon or metal-based thermal grease.

Heatsink 54 includes a thermally conductive material such as those used to fabricate rod 56 including copper, aluminum graphite, and carbon composite materials and is formed using an extrusion, die casting, molding or stamping process. Heatsink 54 includes a plurality of pin fin structures to facilitate dissipation of heat energy collected by heatsink 54 into the surrounding air by convection or another heat-transfer process. Heatsink 54 provides structural support to LED lamp 50 and provides a mounting point for the components of LED lamp 50. Also, heatsink 54 is configured to maintain a particular LED junction temperature within light engine 52 during operation of LED lamp 50 by dissipating heat energy generated by LEDs 58.

Heatsink 54 includes additional holes or passageways to allow leads 60 of light engine 52 to pass through heatsink 54 for connection to a power supply. In some embodiments, however, both leads 60 and rod 56 pass through the same opening formed within heatsink 54.

Power supply 66 is connected to a backside of heatsink 54. Power supply 66 includes connectors for coupling to leads 60 of light engine 52. Power supply 66 receives energy from an electricity source (not shown) such as a wall socket, or other electrical connection, and supplies energy to light engine 52 via leads 60. Depending upon the application, power supply 66 modifies the energy received from the electricity source before delivering it to light engine 52. In embodiments wherein heatsink 54 acts as a heatsink for power supply 66, a thermally conductive material such as thermal grease is deposited between power supply 66 and heatsink 54. For example, in one embodiment, a thermally conductive adhesive material connects power supply 66 and heatsink 54.

Socket 68 is connected to power supply 66 of LED lamp 50. Socket 68 is configured to connect to a conventional light-bulb socket for connecting LED lamp 10 to an electricity source. Socket 68 may include an E26/E27 bulb socket, a GU24 socket, or any other type of connector. Depending upon the application, the electricity source may be a standard 120 VAC, 220 VAC, 277 VAC, or other AC source or a DC power source. In alternative embodiments, however, socket 68 includes any socket for connecting to a power supply for supplying electricity to power supply 66 of LED lamp 50.

An optional optical envelope 70 is mounted to heatsink 54 using a friction coupling, fastener, or other attachment mechanism. Optical envelope 70 may be clear, or coated with one or more light-diffusing materials. In one embodiment, the coating diffuses the intensive spotlight formed by LEDs 58 into a relatively smooth light source.

Figure 3A:
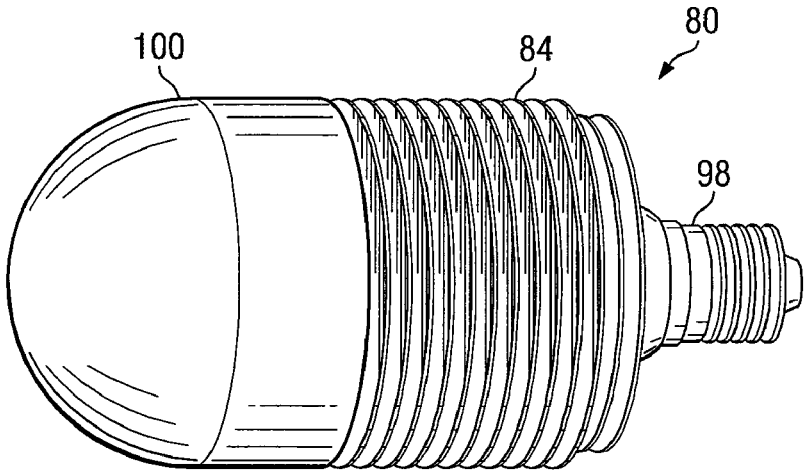
FIG. 3*a* illustrates a perspective view of an LED lamp having a heatsink with a plurality of disc fins for dissipating heat energy.
Figure 3B:
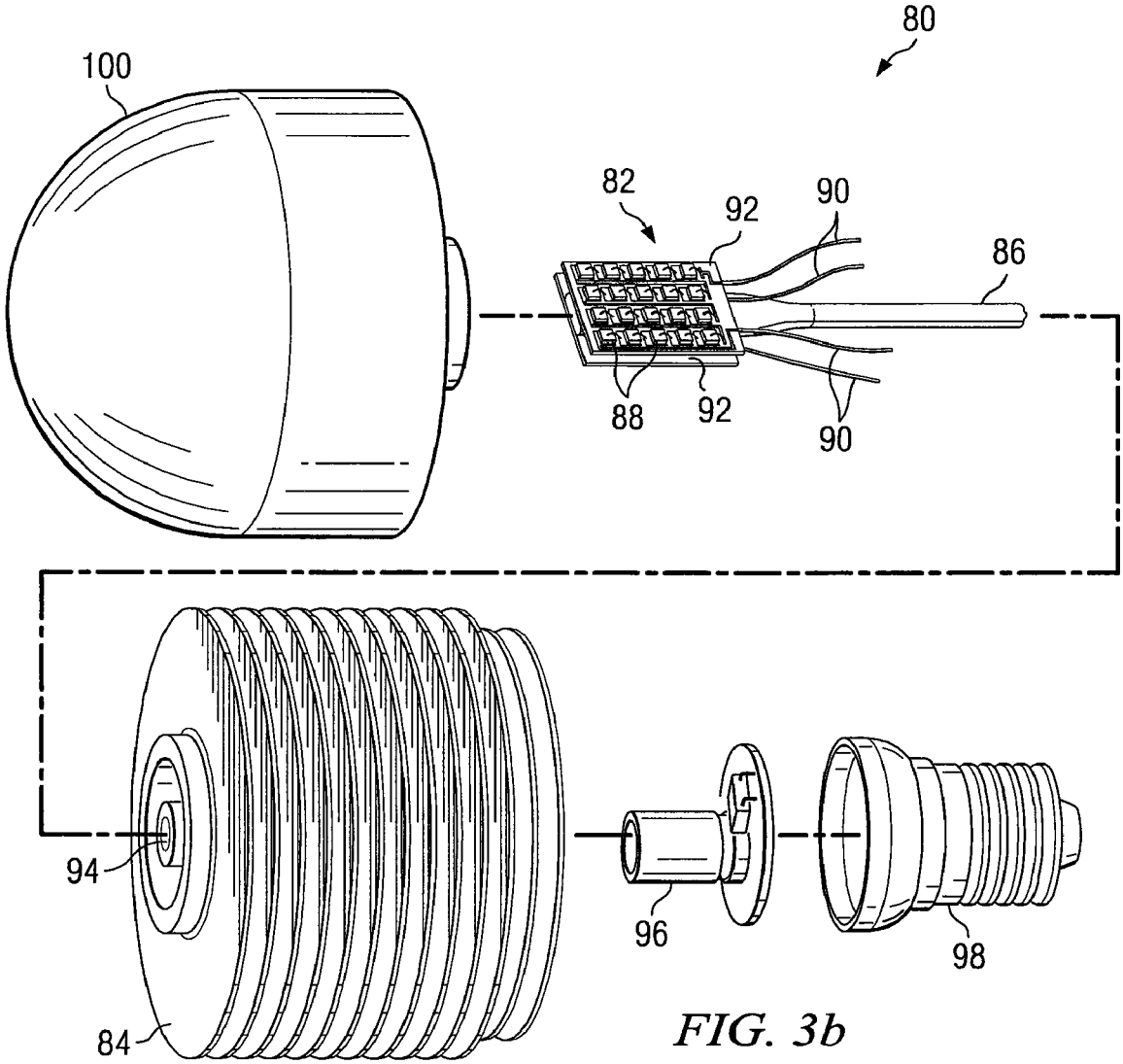
FIG. 3*b* illustrates an exploded view of an LED lamp illustrating how the components of the LED lamp fit together, the LED lamp includes a heatsink with a plurality of disc fins.

FIGS. 3*a* and 3*b* illustrate omni-directional LED lamp 80. FIG. 3*a* shows a perspective view of LED lamp 80 having a plurality of disc fins for dissipating heat energy. FIG. 3*b* shows an exploded view of LED lamp 80 illustrating how some of the components of LED lamp 80 fit together.

LED lamp 80 includes light engine 82 for generating light to be radiated from LED lamp 80. Light engine 82 includes a plurality of LEDs 88 that are mounted to contact pads connected to substrate 92. LEDs 88 are electrically interconnected using wirebonds, traces, or other electrical connections formed over the substrate. Rod 86 is connected or mounted to substrate 92 of light engine 82 and includes a thermally conductive material for collecting and removing heat energy generated by light engine 82. Rod 86 may include aluminum, copper or another thermally conductive material. Leads 90 are electrically connected to LEDs 88 of light engine 82 to supply energy to LEDs 88.

Light engine 82 is mounted to heatsink 84 by inserting rod 86 into recess or opening 94 formed in heatsink 84. Opening 94 is configured so that the outer surface of rod 86 contacts an inner surface of opening 94. The mechanical connection between rod 86 and heatsink 84 facilitates the transfer of heat energy from rod 86 into heatsink 84. Depending upon the application, a thermally conductive material such as thermal grease or a thermally conductive pad is disposed between the outer surface of rod 86 and the surface of opening 94 to further enhance the transfer of thermal energy between rod 86 and heatsink 84. The thermal grease may include a ceramic, carbon or metal-based thermal grease.

Heatsink 84 includes a thermally conductive material such as those used to fabricate rod 86 including copper, aluminum, graphite, and carbon composite materials and is formed using an extrusion, die casting, molding or stamping process. Heatsink 84 includes a plurality of disc fin structures to facilitate dissipation of heat energy collected by heatsink 84 into the surrounding air by convection or another heat-transfer process. Heatsink 84 provides structural support to LED lamp 80 and provides a mounting point for the components of LED lamp 80. Also, heatsink 84 is configured to maintain a particular LED junction temperature within light engine 82 during operation of LED lamp 80 by dissipating heat energy generated by LEDs 88.

Heatsink 84 includes additional holes or passageways to allow leads 90 of light engine 82 to pass through heatsink 84 for connection to a power supply. In some embodiments, however, both leads 90 and rod 86 pass through the same opening formed within heatsink 84.

Power supply 96 is connected to a backside of heatsink 84. Power supply 96 includes connectors for coupling to leads 90 of light engine 82. Power supply 96 receives energy from an electricity source (not shown) such as a wall socket, or other electrical connection, and supplies energy to light engine 82 via leads 90. Depending upon the application, power supply 96 modifies the energy received from the electricity source before delivering it to light engine 82. In embodiments wherein heatsink 84 acts as a heatsink for power supply 96, a thermally conductive material such as thermal grease is deposited between power supply 96 and heatsink 84. For example, in one embodiment, a thermally conductive adhesive material connects power supply 96 and heatsink 84.

Socket 98 is connected to power supply 96 of LED lamp 80. Socket 98 is configured to connect to a conventional light-bulb socket for connecting LED lamp 80 to an electricity source. Socket 98 may include an E26/E27 bulb socket, a GU24 socket, or any other connector. Depending upon the application, the electricity source may be a standard 120 VAC, 220 VAC, 277 VAC, or other AC source or a DC power source. In alternative embodiments, however, socket 98 includes any socket for connecting to a power supply for supplying electricity to power supply 96 of LED lamp 80.

An optional optical envelope 100 is mounted to heatsink 84 using a friction coupling, fastener, or other attachment mechanism. Optical envelope 100 may be clear or coated with one or more light-diffusing materials. In one embodiment, the coating diffuses the intensive spotlight formed by LEDs 88 into a relatively smooth light source.

Figure 4:
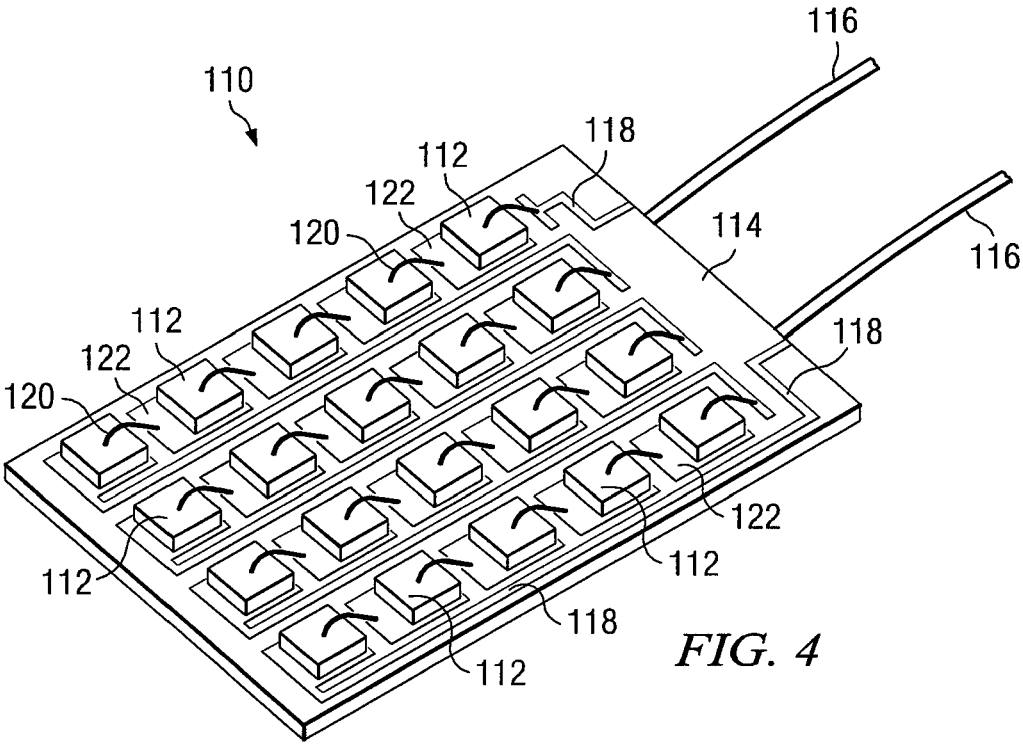
FIG. 4 illustrates a light engine of an LED lamp, the light engine includes a transparent, translucent, or fluorescent substrate and a plurality of LEDs mounted to the transparent, translucent, or fluorescent substrate.

FIG. 4 illustrates light engine 110 having a transparent substrate. A plurality of LEDs 112 are surface mounted to substrate 114. Depending upon the application, LEDs 112 may be mounted over both front and back surfaces of substrate 114. Substrate 114 may include a ceramic material such as AlN, Al2O3, a fiber glass board such as FR4, a metal-clad dielectric board, or a diamond film material. An additional fluorescent or phosphorous material may be formed over a surface of substrate 114 or formed within substrate 114 to further emphasize the light output of light engine 110 and to promote even light spreading. As LEDs 112 generate light, the fluorescent or phosphorous material absorbs some of the photons generated by LEDs 112 and emits additional photons having a particular range of wavelengths. By adjusting the wavelength of the emitted light, the fluorescent or phosphorous material promotes light output and light spreading. The DC voltage from leads 116 is supplied to each LED 112. The DC voltage is routed through metal conductors or trace patterns 118 to supply operating potential to LED devices 112. LED devices 112 can also be interconnected with wirebonds 120 or solder bonds. With reference to FIG. 4, wirebonds 120 are formed between LEDs 112 and contact pads 122 formed over a surface of substrate 114. LEDs 112 may be connected in electrical parallel configuration or electrical series configuration or combination thereof. LEDs 112 can be positioned in a rectilinear pattern, a circular or curvilinear pattern, a random or stochastic pattern, or any combination thereof. The LED devices can be laid out in multiple regions, where each of the regions exhibits different patterns and numbers of devices.

A thermally conductive structure such as a thermally conductive rod or tube may be connected between substrate 114 and a heatsink to transfer heat energy from substrate 114 into the heatsink.

While one or more embodiments of the present invention have been illustrated in detail, the skilled artisan will appreciate that modifications and adaptations to those embodiments may be made without departing from the scope of the present invention as set forth in the following claims.

What is claimed is:

1. A method of manufacturing a light emitting diode (LED) lamp, comprising:

providing first and second light engines each including:

a substrate comprising a transparent or translucent thermally conductive material, a plurality of LED semiconductor devices mounted to the substrate, a plurality of conductive traces formed over the substrate to electrically interconnect each of the plurality of LED semiconductor devices, and conductive leads connected to the substrate for supplying electrical energy to the plurality of LED semiconductor devices;

providing a thermally conductive rod including a circular first end and a flattened second end with a distance between opposing parallel sides of the flattened second end less than a diameter of the circular first end and a face of the flattened second end perpendicular to a length of the thermally conductive rod;

mounting the first and second light engines respectively over the opposing parallel sides of the flattened second end of the thermally conductive rod;

forming a heatsink by an extrusion, molding, stamping, or die casting process to provide a fin structure for dissipating heat energy;

inserting the diameter of the circular first end of the thermally conductive rod into an opening in the heatsink; and mounting an optical housing to the heatsink and disposed over the face of the flattened second end such that the first and second light engines are suspended within the optical housing.

2. The method of claim 1, further including forming a reflector ring over an interior portion of the optical housing, the reflector ring being disposed around the plurality of LED semiconductor devices of the first and second light engines.

3. The method of claim 1, wherein the substrate of the first and second light engines includes an aluminum nitride (AlN), aluminum oxide (Al203), fiber glass board, metal-clad dielectric board, or diamond film material.

4. The method of claim 1, wherein the fin structure of the heatsink includes flat leaf fins, wave lead fins, pin fins, flat disc fins, or wave disc fins.

5. The method of claim 1, wherein the plurality of LED semiconductor devices is selected in accordance with a white light emitting method selected from red, green, and blue (RGB) LED mixing, red, amber, green, and blue (RAGB) LED mixing, blue LEDs coated with phosphor material, or ultra-violet (uV) LEDs coated with phosphor material.

6. The method of claim 1, wherein the substrate of the first and second light engines includes a fluorescent or phosphorous material.

7. A method of manufacturing a light emitting diode (LED) lamp, comprising:

providing a light engine including a substrate and a plurality of LEDs mounted to the substrate;

forming a fluorescent or phosphorous material over or within the substrate;

providing a thermally conductive structure including a circular first end and a flattened second end with a distance between opposing parallel sides of the flattened second end less than a diameter of the circular first end;

mounting the light engine to the flattened second end of the thermally conductive structure;

providing a heatsink including a fin structure for dissipating heat energy;

inserting the diameter of the circular first end of the thermally conductive structure into an opening in the heatsink; and mounting an optical housing to the heatsink such that the light engine and the flattened second end of the thermally conductive structure opposite the circular first end are suspended within the optical housing.

8. The method of claim 7, further including forming a reflector ring over an interior portion of the optical housing, the reflector ring being disposed around the plurality of LEDs of the light engine.

9. The method of claim 7, wherein the substrate of the light engine includes an aluminum nitride (AlN), aluminum oxide (Al203), fiber glass board, metal-clad dielectric board, or diamond film material.

10. The method of claim 7, wherein the fin structure of the heatsink includes flat leaf fins, wave lead fins, pin fins, flat disc fins, or wave disc fins.

11. The method of claim 7, wherein the plurality of LEDs is selected in accordance with a white light emitting method selected from red, green, and blue (RGB) LED mixing, red, amber, green, and blue (RAGB) LED mixing, blue LEDs coated with phosphor material, or ultra-violet (uV) LEDs coated with phosphor material.

12. The method of claim 7, wherein the light engine includes:

a plurality of conductive traces formed over the substrate to electrically interconnect each of the plurality of LEDs; and conductive leads connected to the substrate for supplying electrical energy to the plurality of LEDs.

13. A method of manufacturing a lamp, comprising:

providing a light source including a substrate;

forming a fluorescent or phosphorous material over or within the substrate;

providing a thermally conductive structure including a circular first end and a flattened second end with a distance between opposing parallel sides of the flattened second end less than a diameter of the circular first end;

mounting the light source to the flattened second end of a thermally conductive structure;

providing a heatsink for dissipating heat energy;

inserting the diameter of the circular first end of the thermally conductive structure into an opening in the heatsink; and mounting an optical housing to the heatsink such that the light source is suspended within the optical housing.

14. The method of claim 13, wherein the includes an aluminum nitride (AlN), aluminum oxide (Al203), fiber glass board, metal-clad dielectric board, or diamond film material.

15. The method of claim 13, wherein the heatsink includes a fin structure, the fin structure including flat leaf fins, wave lead fins, pin fins, flat disc fins, or wave disc fins.

16. The method of claim 13, wherein the light source includes a plurality of LED semiconductor devices, the plurality of LEDs being selected in accordance with a white light emitting method selected from red, green, and blue (RGB) LED mixing, red, amber, green, and blue (RAGB) LED mixing, blue LEDs coated with phosphor material, or ultra-violet (uV) LEDs coated with phosphor material.

17. The method of claim 13, further including disposing the optical housing over the flattened second end of the thermally conductive structure.

18. A light emitting diode (LED) lamp, comprising:

a light engine including a substrate and a plurality of LEDs mounted to the substrate;

a thermally conductive structure including a circular first end and a flattened second end connected to the light engine with a distance between opposing parallel sides of the flattened second end of the thermally conductive structure less than a diameter of the circular first end;

a heatsink including a fin structure for dissipating heat energy and with a diameter of the circular first end of the thermally conductive structure inserted into an opening in the heatsink; and an optical housing mounted to the heatsink and disposed over the flattened second end of the thermally conductive structure.

19. The LED lamp of claim 18, wherein the light engine is suspended within the optical housing.

20. The LED lamp of claim 18, wherein the substrate of the light engine includes an aluminum nitride (AlN), aluminum oxide (Al203), fiber glass board, metal-clad dielectric board, or diamond film material.

21. The LED lamp of claim 18, wherein the fin structure of the heatsink includes flat leaf fins, wave lead fins, pin fins, flat disc fins, or wave disc fins.

22. The LED lamp of claim 18, wherein the plurality of LEDs is selected in accordance with a white light emitting method selected from red, green, and blue (RGB) LED mixing, red, amber, green, and blue (RAGB) LED mixing, blue LEDs coated with phosphor material, or ultra-violet (uV) LEDs coated with phosphor material.

23. A method of manufacturing a light emitting diode (LED) lamp, comprising:

providing a light engine including a substrate and a plurality of LEDs mounted to the substrate;

providing a thermally conductive structure including a circular first end and a flattened second end with a distance between opposing parallel sides of the flattened second end less than a diameter of the circular first end;

mounting the light engine over the thermally conductive structure;

providing a heatsink including an opening extending from a first surface of the heatsink to a second surface of the heatsink opposite the first surface;

inserting the diameter of the thermally conductive structure into the opening in the heatsink; and mounting an optical housing to the first surface of the heatsink with the light engine suspended within the optical housing.

24. The method of claim 23, wherein the substrate includes aluminum nitride (AlN), aluminum oxide (Al203), fiber glass board, metal-clad dielectric board, or diamond film material.

25. The method of claim 23, further including forming a fluorescent or phosphorous material over or within the substrate.

26. The method of claim 23, wherein the heatsink includes a fin structure, the fin structure including flat leaf fins, wave lead fins, pin fins, flat disc fins, or wave disc fins.

27. The method of claim 23, wherein the LEDs are selected in accordance with a white light emitting method selected from red, green, and blue (RGB) LED mixing, red, amber, green, and blue (RAGB) LED mixing, blue LEDs coated with phosphor material, or ultra-violet (uV) LEDs coated with phosphor material.

* * * * *